US005953939A

United States Patent [19]

Guerrero-Parra et al.

[11] Patent Number: 5,953,939

[45] Date of Patent: Sep. 21, 1999

[54] WASH SYSTEM BY RECIRCULATING PUMPING WITH SELF BALANCED CENTRIFUGAL SQUEEZE DRY OF LAUNDRY

[76] Inventors: Gilberto Manuel Guerrero-Parra; Salvador Virgilio Guerrero-Parra, both of Eligio Ancona No.107, Col. Santa Maria la Rivera, Mexico, 06400

[21] Appl. No.: 08/715,963

[22] Filed: Sep. 19, 1996

[30] Foreign Application Priority Data

Sep. 21, 1995 [MX] Mexico ..... 954040

[51] Int. Cl.[6] ..... D06F 37/24

[52] U.S. Cl. ..... 68/23.3; 74/573 F; 68/23.2

[58] Field of Search ..... 68/23.2, 23.3; 74/573 R, 573 F; 210/144

[56] References Cited

U.S. PATENT DOCUMENTS

| | | | |
|---|---|---|---|
| 4,646,545 | 3/1987 | Fanson et al. | 68/23.2 |
| 4,711,105 | 12/1987 | Oida et al. | 68/23.2 |
| 5,176,012 | 1/1993 | Oh et al. | 68/23.2 |

FOREIGN PATENT DOCUMENTS

| | | | |
|---|---|---|---|
| 52-62977 | 5/1977 | Japan | 68/23.2 |
| 63-117797 | 5/1988 | Japan | 68/23.2 |
| 4-40998 | 2/1992 | Japan | 68/23.2 |
| 345322 | 5/1960 | Switzerland | 68/23.2 |

*Primary Examiner*—Frankie L. Stinson
*Attorney, Agent, or Firm*—Ladas & Parry

[57] ABSTRACT

The present invention relates to a clothes wash system by means of the method of recirculating pumping of water, which is adapted to a squeeze dry system, that consists in eliminating by the centrifugation method, the excess of water impregnated in the just washed laundry making the drum that contains said laundry, to rotate freely over a virtual axis that passes by the mass center of the assembly, to avoid vibrations and allowing a higher rotation velocity.

11 Claims, 3 Drawing Sheets

WASH SYSTEM BY RECIRCULATING PUMPING WITH SELF BALANCED CENTRIFUGAL SQUEEZE DRY OF LAUNDRY

BACKGROUND OF THE INVENTION

The object of this invention is to have a more effective centrifugal drying system, in addition to being able to adapt thereto a recycle pump wash system as the one disclosed in Mexican patent application No. 938129, to one of the present authors. Because this new drying method, unlike those currently existing, is based, on the fact that the spin drum or rotatory drum is not driven or held by a driving axis, rigidly linked to its geometrical center, there is the advantage of not requiring shock absorbers, or any other type of mechanisms to reduce the vibration effects caused by the unbalance produced by the asymmetric location of laundry within the rotatory drum. Firstly, we will describe this drying system and thereafter, its adaptation to the washing system.

SUMMARY OF THE INVENTION

According to the invention, the novel centrifugal drying system consists mainly of an inner rotatory drum or perforated spin drum, freely floating over a certain amount of water contained in a second closed external drum. This feature allows that the inner drum and the clothes or laundry therein contained as a whole, tend to spin over its mass center avoiding the unbalance and allowing the spinning at higher speeds and diameters of the drum. The spinning drive of the centrifugal drum is made either by a driving axis in the form of a free contact swivel, that drives circumferentially a flat and vertical surface radially joined to the bottom of the drum or by means of water jet injecting nozzles impinging against radial blades or paddles, also fixed to the bottom of the spinning drum, in the way of a Pelton wheel.

Figure 1:
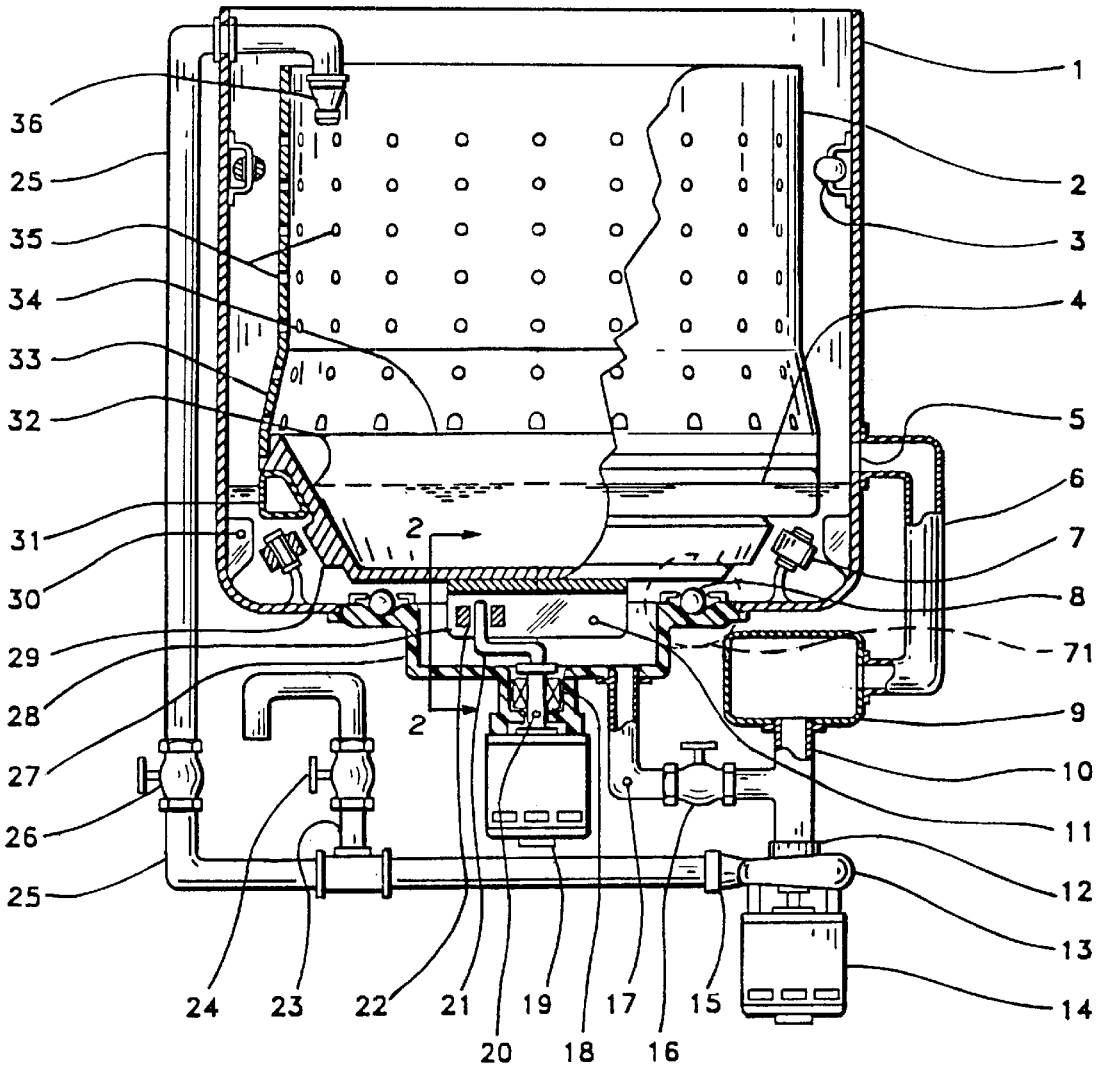
FIG. 1 is a vertical, sectional view of a centrifugal drying system according to the invention.
Figure 2:
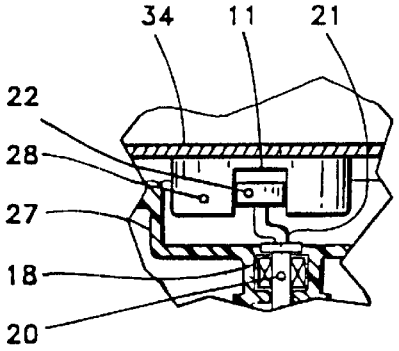
FIG. 2 is a sectional view taken along line 2—2 in FIG. 1.

Regarding FIG. 1, it can be seen that the inner rotatory drum (2) is formed by two parts, the first is the base or bottom (34), truncated or rounded conically shaped (32) and without perforations, of a certain height and relative large weight; the second part or upper part forms the cylindrical body of the drum and has a series of holes (35) along the whole periphery to withdraw the spinned water, being of relative low weight or made of light material so that the gravity center of both parts of the drum remains as low as possible. It is suitable that the second part of the drum in its lower part shows a certain broadening (33) (FIG. 3) or conicity (33) (FIG. 1) contrary to that of the base (34) at the joint thereof, with the purpose of forming a sort of bend or butt that prevents the laundry when spinning, tends to slide upwardly and to originate another unbalance plane or mass center at a upper height or level.

The gravity center of the whole inner drum (2) and its flotation center should be determined in a way that, considering the several operating conditions, the flotation center remains always over the gravity center to keep a strong tendency to stable balance. On the other side, the drum must have a balanced mass distribution relating its geometric axis, further that the mass or inertia of its base (34) be of such amount that the normal unbalance produced by asymmetrical distribution of the laundry itself originates a slight shift of the mass center of the set with reference to the geometrical axis of the drum. The base height must be such that the upper border thereof always remains over the water level on which it floats, so that in any swinging or tilting condition of the drum when spinning, the water will not enter or overflow within the same base. To improve the above conditions, a flotation hollow ring (31) can be located in the upper part and a inertia and mass ring (29) in the lower part, around the base (34) of the spinning drum. Further, the hollow ring can be used to introduce in it a certain amount of water so that when spinning the drum and the ring out of its geometrical center, the flow of water within the ring counteracts, in a certain measure the shifting of the gravity center with reference thereto.

The external drum (1) containing the inner rotatory drum (2) is closed and houses a certain constant level (4) of the water in which the inner drum floats and spins. To fix and keep such a level, the external drum has at the height of said level, one or several exits or mouths (5) to discharge the water used in the wash or the rinse; in a way that this also may work as a drain of excess water to determine and control the pre-set flotation level of the internal drum within the external drum. The drain mouths or exits (5) are connected through a line (6) with a closed container or chamber (9), in which the water excess, produced during the drying operation is poured and housed to be discarded later by the system's pump (13), which suction (12) is connected by a line (4) to the chamber (9) and the discharge (15) to the drain tubing (23) with its corresponding valve (24). The closed chamber can be dispensed with if the system's pump operates parallel to the drying cycle to avoid the accumulation of the water excess produced thereat.

The system providing the spinning drive to the inner rotatory or spin drum (2), is centrally located in a chamber or cavity (27) at the bottom of the external drum (1) and that also is connected by a line (17) with its corresponding control valve (16) to the suction of the system's pump (13), to discharge after each drying operation, the water used for flotation of the spinning drum. The already mentioned methods to apply a spinning free drive to the rotatory drum are described as follows:

The first method, shown in FIG. 1, comprises using a driving axis (20) whose end (21) has a double 90 degrees turn in the form of a swivel and entering at the bottom of the chamber (27) through a hole centered with the geometrical axis of the whole set; this hole being protected against water leaks by a mechanical or other type seal (18). At the end of the swivel (21) it is located a cylindrical or spherical bearing (22) within the walls of a radial or diametral channel (11) formed in the lower part of a cylindrical body (28) joined to the bottom of the spin drum (2); being, the reason of the cylindrical shape of this body to avoid the water resistance to spin. The swivel arm is sufficiently long so that the contact point and drive of the bearing (22) with the channel (11), remains always farther from the drive axis (20) or geometrical center than the distance that may be separated the possible mass center of the drum, so that it may tend to spin over the virtual axis passing by such mass center.

As above stated, by spinning the drive axis (20), the bearing (22) at the end of the swivel (21) circumferentially drives one of the channel walls (11) in which it is housed and upon having free contact with such wall, it can turn and shift short distances along the channel to compensate in each revolution, the eccentricity between the circumference drawn by the swivel and the virtual spin axis of the rotatory drum. The drive axis (20) can be moved directly or indirectly, by its own electric motor or by the same motor (14) driving the pump (13) of the system through a single clutch coupling. The section 2—2 in FIG. 1 is to better focus this mechanism to make the drum to spin over the virtual axis passing through the mass center. Instead of the bearing, there it can be located at the end of the swivel a rectangular body or block that may spin on this axis and having a moderate length, a width slightly adjusted to the channel width and a height lower than the depth thereof, in a way that besides allowing the spinning drive, works as a sliding runner that within the channel (11) can also absorb displacements thereof produced by swing or tilting of the spin drum. This method is not represented in the Figures.

Figure 3:
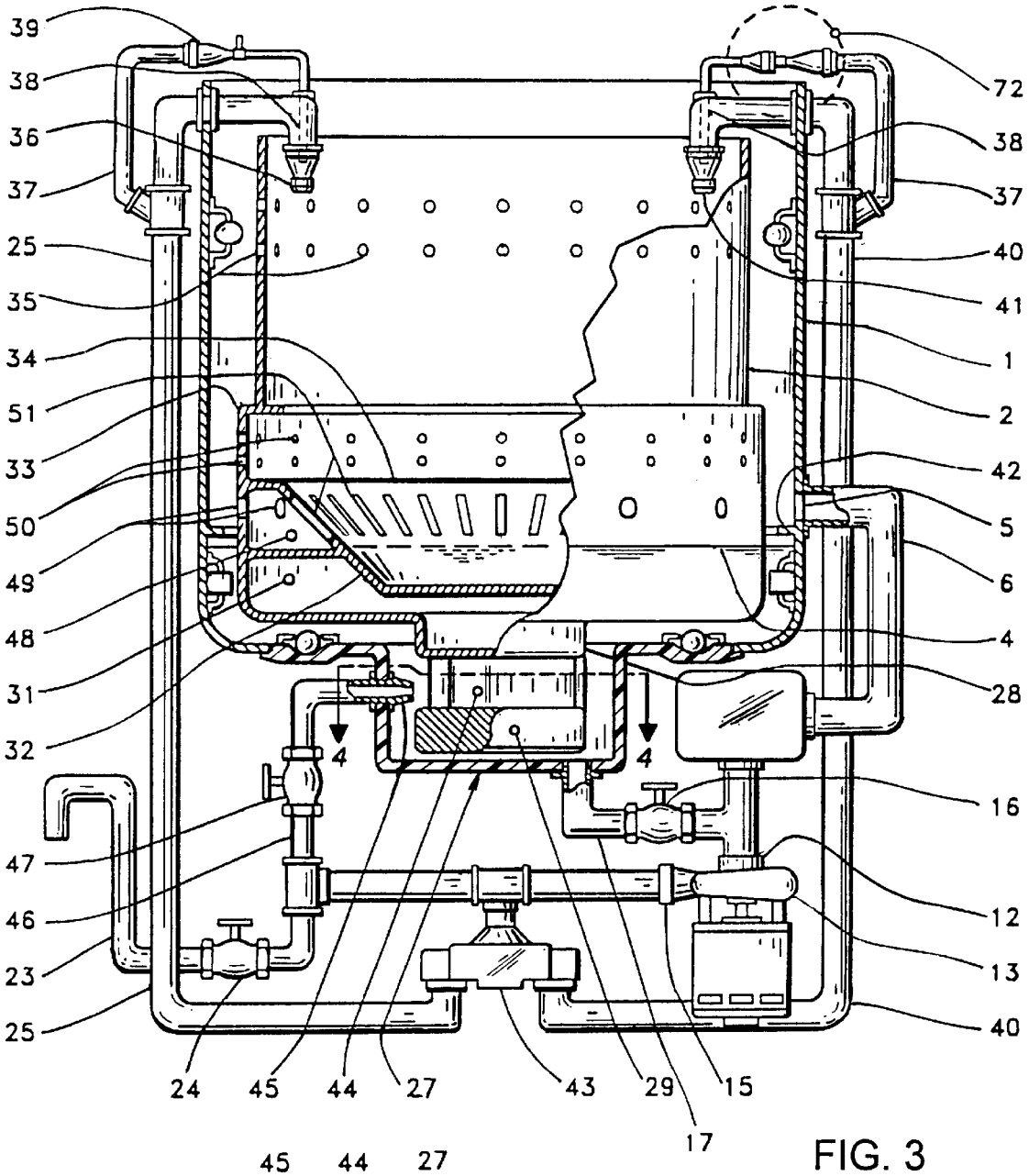
FIG. 3 shows another embodiment of the centrifugal drying system.

The second method to freely provide a spinning drive to the rotatory drum (2), can be seen in FIG. 3, which is similar to FIG. 1, but for certain changes in the wash and dry elements, and in which the same reference signs are used as in FIG. 1 for some elements having the same function, even though they are of a different shape.

Figure 4:
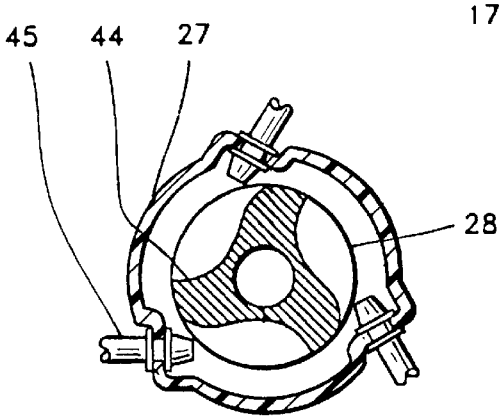
FIG. 4 is a sectional view taken along line 4—4 in FIG. 3.

In this second option, for imparting rotation to the drum, there are disposed peripherically within the chamber (27), a series of water jet injecting nozzles (45) connected to the discharge (15) of the system s pump (13), through a line or tubing (46) with its corresponding control valve (47). The water jets are fed by the pump making the water housed in the external drum (1) and in the chamber (27) to recirculate continuously in a pump closed circuit. This water being returned at the bottom of the suction chamber (12) of the pump by means of the tubing (17) connecting both. The nozzle jets are directed perpendicularly to the surfaces (44) radially engraved, instead of the channel of the previous method, in the cylindrical body (28) joined at the bottom of the spin drum (2), in such a manner that the collision of water against these surfaces, in a Pelton wheel buckets fashion, provides the cylindrical body with a tangential impulse to make the drum spin. The impulse given by each one of the nozzles must be uniform in all of them. The arrangement of this method can be better seen in FIG. 4.

On the other side, the rotatory drum (2) of FIG. 3 slightly differs from the equivalent drum of FIG. 1. In this case, the bottom or base (34) of the drum has also a conical shape, but contrary to FIG. 1, provides a series of rectangular grooves or openings (51) in vertical position and around the whole conical side (32), so that in order to achieve flotation it is necessary to count with a hollow ring or flotation chamber (31) similar to that of the previous case but bigger. In FIG. 1 the mass ring (29) or overweight can be located, as added to the cylindrical body (28), under the Pelton wheel drive system, thus the gravity center of the assembly will remain at a level below than otherwise.

In FIGS. 1 and 3, it is noted that in the space between both drums (1 and 2), suitably distributed at different levels, there are located a series of spherical (3) or cylindrical (7) bearings that can be mounted over axis with shock absorbing systems. These bearings upon spinning help the rotatory drum (2) to bear and spin upon them when the swing and tilt or precession movements thereof occur; in such a way that the friction between both drums is avoided and such parasitical movements of the drums are limited and controlled. The distance between these bearings and the body of the rotatory drum (2) must be large enough for not avoiding it to spin over the mass center of the drum and clothes set, and small enough so that the drum does not swing excessively.

Figure 5:
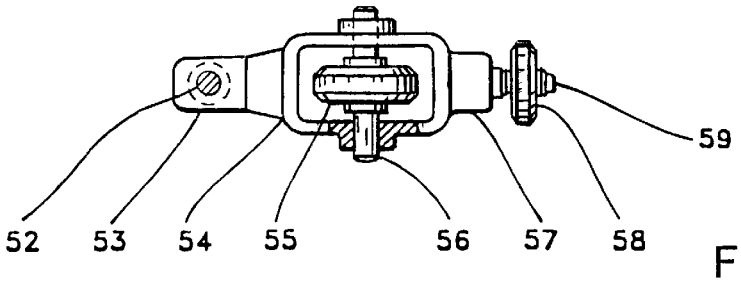
FIG. 5 shows, on enlarged scale, a detail in FIG. 3.
Figure 6:
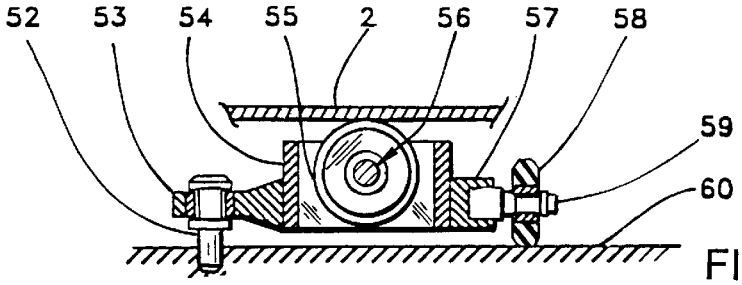
FIG. 6 is a sectional view of the detail in FIG. 5.

At the bottom of the external drum (1), in both figures mentioned, a bearing system is also provided, in which the rotatory drum base (2) can rotate freely and eccentrically when it is not floating, and bear over said bearings. The bearings can comprise balls or small balls (8) located in beds or small cavities at the bottom of the external drum and held by detents. This small balls (8), FIG. 1, can be substituted by common self aligning axis bearings or by special self aligning bearings indicated, on a large scale in FIGS. 5 and 6, and described as follows.

The self aligning bearing shown in FIG. C is similar to the present ones and like those, has a bearing (55) whose spin axis (56) is held by the system's frame (54) which in one of its ends (53) pivots upon a second axis (52) perpendicular to the first axis (56) and vertically founded in the static support frame or at the flat bottom of the external drum (1). Over this first bearing the moving plane or bottom of the inner drum (2) slides and holds, the bearing being aligned to the direction of this movement by the free rotation of the frame over the second axis (52) or alignment axis. Thus far this common system has the advantage that the low support is concentrating on the pivoting axis (52). For a better low distribution, at the other end of the frame (57), opposite to the first end (53), it is added a third axis (59) perpendicular to the two previous axis, and on which the second bearing (58) rotates circumferentially having its center in the pivoting axis (52) over a plane (60) perpendicular thereto, and belonging to the static support structure or to the bottom of the external drum. In this way, the load is shared by the alignment or pivot axis with this second bearing.

To avoid that the spin drum (2) upon spinning transmits its rotation to the water in which it floats and the surface thereof reduces its central level and increases the perimetral level, there are disposed a series of radial blades or paddles (30), located on the wall of the external drum (1). Said radial blades or paddles break or restrain the rotatory impulse. As shown in FIG. 1; or otherwise as shown in FIG. 3, a peripheral annular plate or screen (42) can be arranged over the normal level of water as a stop for the increase of the level in this zone.

The spin cycle operates after the wash or rinse operations, and starts by discharging the water used in these cycles by means of the system's pump (13), opening the corresponding valve (24) towards the drainage (23) but keeping closed the valve (16) of the tubing (17) that drains the chamber (27) at the bottom of the external drum. The water is displaced from the drums by the exit mouths (5) to its overflow level, remaining at this level (4) the amount of water needed to permit flotation of the rotatory drum (2). At this point of emptying of the drums, the clothes upon settling are deposited in a fashion more or less uniform at the bottom of the rotatory drum, which in the case of FIG. 3 will remain containing only the water soaking cloths and in the other case, that of FIG. 1, the drum will remain full of water only up to the edge of its conical base (34) lacking holes.

When the displacement of excess water for the flotation of the inner drum (2) is over, the rotation of said drum is started by means of any of the driving systems already described, and keeps spinning to eliminate enough humidity from the clothes. In the case of FIG. 1, because of the weigh of the water, which at the beginning of the rotation stills fills the base (24) of the spin drum (2), it settles and rotates upon the bearings (8) of the bottom of the external drum (1) until the water is rapidly displaced from the interior of the base due to its own conicity; after which the drum will normally float for the rest of the rotation.

The excess water produced during the spin operation is poured at the overflow mouth or exit (5) towards the temporary housing closed vessel (9) or directly drained by the pump. When drain is finished, the spin system chamber (27) valve (16) is opened and the water used for the flotation of the drum and the water housed in the closed vessel (9) are pumped to drainage.

Following, it will be described the recycle pumping wash and spin system, in which the already described spin system may be adapted.

Basically, this wash and spin system consists in introducing vertically, at the upper part of the inner drum (2), the water jet injection nozzles (36) that produce the recirculating currents within the drum, with the purpose that the nozzles system do not impede or block the rotation of the drum during the squeeze dry operation.

In FIG. 1, the nozzle or series of nozzles are disposed downwardly at a certain depth from the border of the drum (2) and close to a side thereof, to inject vertical jets producing recirculating currents in the vertical planes, in such a manner that the water jets suck and abruptly carry the laundry traversing with the currents by the upper part of the drum. These nozzles are connected by means of an external tubing (25) to the drums and to the respective control valve (26) to the discharge (15) of the system's pump (13); the suction thereof (12) as already explained is connected to the overflow and drain system of the drums, already described. Thus the water that is injected by the nozzles and circulates within the internal drum (2) is constantly returned by the holes (35) thereof, and by the drain system towards the pump suction which again drives it to the nozzles to establish thus the pump closed circuit.

The nozzles (36) are enough separated from the side wall of drum (2) to avoid frictions against it which could be produced by the swinging during rotation of the drum, and also may be coupled to the feed tubing (25) in a telescopic fashion to adjust its height to different fill water levels within the drum. On the other side, to improve the washing with the periodical change in the orientation of the washing currents, the inner drum (2) is caused to rotate slowly by means of brief drive activation operations of the hereinbefore described rotation systems.

In FIG. 3 the wash system is basically the same as in FIG. 1, except that in this second Figure or version other ideas to increase the efficiency of the wash system adapted to the spin method described in the prior paragraphs are shown.

In the first place the inner wash and spin drum (2) contrary to FIG. 1 has a substantial amount of long and narrow openings (51) vertically located around the conical side wall (32) of the drum bottom or base (34). These openings (51) or grooves communicate to a closed chamber or space (48) below the conical base of the drum, which has only some holes or ducts with limited area communicating to the outside of the drum. Also, contrary to the inner drum of the first Figure, the drum (2) of this Figure has only a few holes (50) of limited area for the centrifugation, slightly over the conical bottom and some others (35) at the upper half part or top of the drum.

This special configuration of the inner drum (2), has as purpose that the impulse of the water jets from the nozzles (36) on the large water mass filling the drum does not impinge totally in this mass, in such a manner that the speed of the recirculating currents, carrying the laundry therewith is not too high or similar to the water jet, so that the laundry is at a slower speed than the jet and be abruptly carried by it when passing under it; further that the pumping power necessary will be lower than that consumed to impulse all the water in fast recirculating currents.

It is so that part of the water jet, coming from the upper part, finds direct exit by the rectangular openings (51) of the conical bottom towards the transit closed chamber or space (48) by which holes or ducts (49) of predetermined area proceed in its way towards the outside of the drum (82) to continue towards the suction (12) of the system's pump. The area of this holes (49) determines the amount of water directly returning to the suction of the pump by this duct, being the other part, enough to carry the laundry, forced to continue circulating by the drum to exit through the upper holes thereof and also returning to the suction.

In this case the reason for the conical shape of the bottom (32) of the drum and its side wall arrangement of enough number of long and narrow grooves (51), is to allow the laundry to slide on the side and do not become stagnant in such part, the fabrics do not penetrate the grooves and that the water may exit easily through them even when partially blocked by the laundry in transit, which further by pushing the preceding rest of the laundry helps to the recirculating currents to carry the laundry towards the nozzle jets. A sufficiently large total area of the grooves (51) located in the zone below the water jets allows the speed of part thereto exiting through them be low and thus not press excessively the laundry against the grooves.

At the upper part of the tubing (25) feeding the nozzle (36) and close to it, ther is a tube (37) of a lower diameter connected in bypass, by which small amounts of the total flow is bypassed. In series with the lower tubing (37) there is connected a vacuum pump or Venturi (39) that absorbs the atmospheric air at a low pressure and then injects same (38) in the form of bubbles at the exit current of the nozzle. These bubbles when exiting at the atmospheric pressure within the circulating currents, are imploded and produce small shock waves within the water helping the laundry wash.

Figure 7:
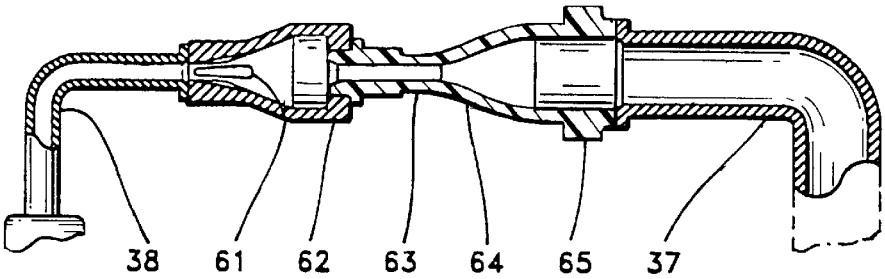
FIG. 7 is a sectional view of a modified embodiment for producing shock waves in the centrifugal drying system.
Figure 8:
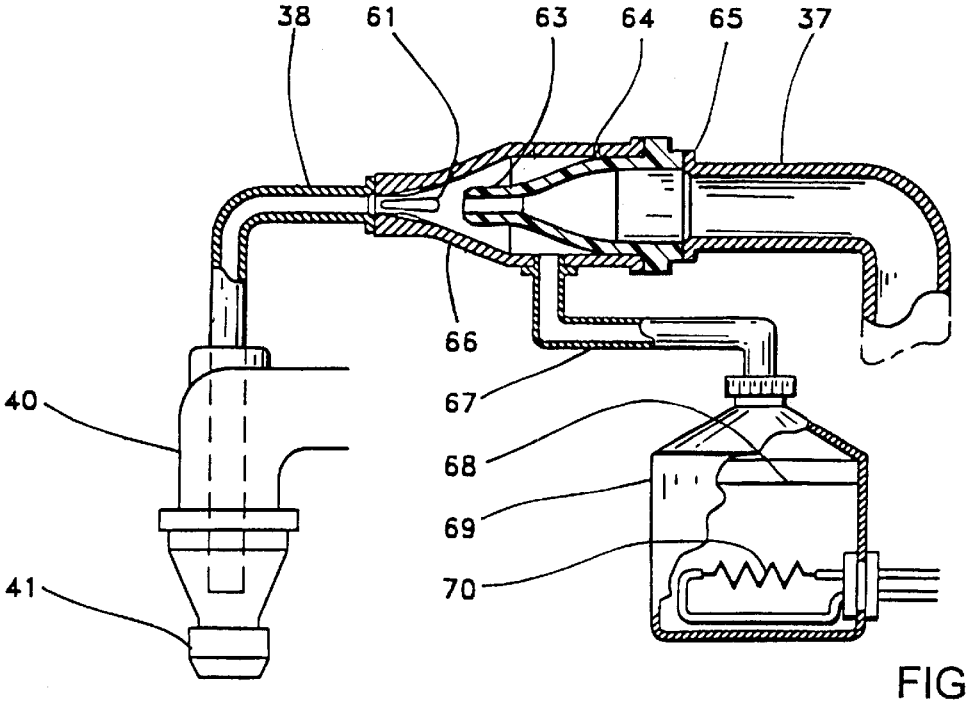
FIG. 8 is a sectional view of another embodiment for producing shock waves in the centrifugal drying system.

Another two ways of producing these shock waves are shown amplified in FIGS. 7 and 8. In FIG. 7 and in the amplification (72) in FIG. 3 one of these ways consists in connecting in series with the same bypass tubing (37), mentioned in the previous paragraph, a first part (65) of a Venturi tube that gradually reduces (64) its diameter (63) to lower the water pressure, and increasing its speed, after which, in a second part (62) it is abruptly broadened and then again to gradually reduce its diameter to the previous diameter. The length of this second part (62) must be short, or the entrance tubing (63) thereto must be close to the exit tubing (38) so that the water vein diameter and its speed are preserved when passing by the broadening of its parts. In this fashion, a vaccum cavity is formed within this second part (62) in which the cavitation phenomena is produced by evaporating the water within the cavity, due to the low pressure within and the steam being carried in the form of bubbles by the water current within the discharge tubing towards the exit of the nozzle (41) in which the steam bubbles are imploded at atmospheric pressure and producing the small shock waves in the manner already mentioned. At the exit of the second part, small vanished and longitudinal veins (61) are made, which allow that the current may drag the steam bubbles and initially, also dragging and discharging the air that remains trapped in the cavity upon establishing the water current.

The other manner to produce the shock waves by cavitation is shown in the lower part of FIG. 8. In this figure it is noted that, a vaccum pump is connected in series with the bypass tubing (37) as well as in the previous cases, said vacuum pump comprising a Venturi tube (65) whose exit tube (63) and gradually reduced diameter (64) remains close to the carrying veins (61) located at the exit, also reduced of the suction chamber (66) surrounding the Venturi tube and is connected also to the discharge tube (39) ending within and to the exit of the nozzle (41). The suction tube (67) of the chamber (66) instead of connecting to the atmosphere as in the first case, is connected to a closed vessel (69) within which, normally it is desired to produce vaccum. In this case the vessel (69) filled with water (68) is heated by an electric resistance (70) or another type of heater to a suitable temperature producing vaporization thereof at the vaccum pressure within the vessel. The water steam produced is continuously carried and discharged from the container by means of the water current at the exit of the vaccum pump and driven in the form of bubbles by the tubing (38) towards the nozzles. Temperature, pressure and size of steam bubbles as well as the path thereof within the tubing (68), the current pressure within it and the steam dilution in water must be considered so that the bubbles implode with strength enough in the interior of the wash currents.

In FIG. 3 the washing system instead of having a single nozzle (36), or a set thereof, only in one side of the inner drum (2), as in FIG. 1, has another nozzle (41) opposite to the first within the drum, so that both operate alternatively and change, at predetermined intervals of time, the sense of rotation of the recirculating currents within the drums. As in the first nozzle, this second nozzle is connected by means of a tubing (40) to the discharge of the system pump (15) but in this case both tubings (25) and (40) are connected to the pump through a double automatic valve (43) which alternates the pass of the flow from one tubing to another.

Having thus described the invention, it is considered as novel and claimed as property that contained in the following claims.

What is claimed is:

1. A self balanced spin dry recycle pump laundry wash system, of the type comprising a water centrifugal drying system to eliminate the water that wets the just washed laundry and eliminates the water by introducing the laundry within an inner rotatory drum having holes at its wall side, comprising:

an inner rotatory drum, that floats while it is rotating over a certain amount of water housed at a controlled level within a second closed external drum; the first, inner drum lacks holes in its base or lower part; the bottom of this drum is flat, and has a side that broadens upwardly in a conical or round form; the upper part or body of the drum is provided with holes and is of a cylindrical form, with a conical or cylindrical broadening in a zone joined to the base, in such a way to form a detent bend for laundry sliding upwarldy; an overweight located at the lower part of the inner drum, placed in a way that the gravity center in relation with the flotation center keeps a stable balance and a flotation level suitable during the centrifugation operation; the inner rotatory drum is provided at the bottom thereof, with a counterweight which is self adjustable to the displacement of the mass center; the external drum has on its wall side, at the same level that the predetermined water level used for the flotation of the inner drum, one or more discharge exits or overflow mouths, connected to a closed container in which the excess water is poured by gravity; the container in turn, is connected directly to a discharge pump suction; the bottom of the external drum is also connected to the suction of the pump by means of tubing with a control valve; in the zone in which the water for flotation of the inner drum is housed, the external drum is provided with means to impede the rotation of the water, said means serving as a detent to the perimetral increase of the water level when it spins due to the impulse of the drum when rotating; in the space defined between the wall sides of the two drums, there are located a series of small bearings, mounted in vertical axis and distributed evenly, which have as a function that of avoiding friction between both drums, since they keep a certain side slack, in such a way that the rotation of the inner drum over its shifted mass center is not impeded and at the same time the irregular swing movements of the drum when spinning is limited; in the bottom of the external drum, are mounted a series of self aligning bearings or balls with detents, circumferentially distributed in such a manner that the inner drum can rest over them and rotate with respect to its variable mass center.

2. Wash system according to claim 1, wherein the counterweight that is self adjustable to the shifting of the mass center, comprises a peripheral, hollow, centered and closed chamber within which it is located a certain amount of water.

3. Wash system according to claim 1, wherein the means to impede the water rotation comprises a series of radial plates vertically fixed and distributed in the inner wall side of the external drum, in the zone in which it houses the water for flotation of the internal drum.

4. Wash system according to claim 1, wherein the means to impede the water rotation comprises an annular screen horizontally located in the internal periphery of the external drum and over the normal level of water in a way that it works as a stop to the perimetral increase of this water level.

5. A wash system according to claim 1, wherein the self aligning bearings in the bottom of the external drum comprise a long frame that in one of its ends is suspended and supported at the end of a pin or axis vertically mounted in the bottom of the external drum or in the static support structure, about which the frame rotates or pivots to align itself with the movement direction of the bottom of the inner drum or rolling surface at any moment; the bearings about which the drum or the plane in movement slides and rests, are mounted at a distance from the pivoting axis, enough to produce the torque necessary to align them with the movement of the plane and its rotations axis is perpendicular to the pivoting axis; at the other end of the frame, opposite to the pivoting axis, it is mounted a third axis, which is perpendicular to the two previous axes, about which rotates a second bearing which displaces or rolls circumferentially having a center in the pivoting axis over a plane of support which is perpendicular to said axis, in a way that a cantilever load is avoided on the pivoting axis by distributing the load or weight of the drum vertically at the ends of the frame over the pivoting axis and the second bearing.

6. Wash system according to claim 1, further comprising a system to transmit freely or without a rigid or flexible coupling a rotatory impulse to the rotatory drum, comprising:

a cylindrical body, joined centrally to the outside of the bottom of the rotatory drum, having in its lower part a groove or diametral channel within which it is housed the extension or free end of a driving axis having a double bend at straight angles, as a swivel, which provides a rotatory impulse to the cylindrical body and the drum, circumferentially driving the end of the swivel to the wall of the channel; the driving point has a free displacement within the channel and excentrically varies with respect the channel, in such a way that the drive point always remains farther from the geometrical center of the set than the mass center of the drum from the drive point in conditions of operation; at the drive point it is mounted a driving element which provides the necessary impulse for making the cylindrical body to rotate; the above mentioned elements are located in a cylindrical chamber which is open on its upper part and that is centrally joined to the bottom of the external drum, forming a projection of the bottom; at the bottom of the chamber it is located a central hole that permits the pass towards the interior of the other end of the driving axis, such hole is protected against the water leaks by means of a tight seal; the axis is coupled by its external part to the mechanism or engine driving it.

7. A wash system according to claim 1, wherein the system for transmitting a rotatory impulse, freely or without a rigid or flexible coupling to the rotatory drum comprises:

a cylindrical chamber, open in its upper part forming a continuation of the bottom of the external drum, and located in central form below the bottom; in the inside of the chamber it is adapted a Pelton type system, comprising a horizontal wheel, joined and centered at the bottom of the rotatory inner drum, and injection nozzles for injecting corresponding tangential water jets inside the chamber around the wall side thereof; the Pelton wheel is made of a cylindrical body which in its wall sides is provided with buckets having walls perpendicular to the impinging of the water jets; the water that feeds the injecting nozzles that provide the movement to the Pelton type wheel within the chamber, is the same that is contained in the chamber and in the bottom of the external drum, which is pumped in closed circuit connecting the bottom of the chamber to the suction of the pump, whose discharge through a control valve is connected to the feed of the nozzles.

8. A wash and dry system according to claim 1, comprising a recirculating pumping system comprising a series of injection nozzles that inject water jets within the wash and dry drums, which produce recirculating currents within the drum; the water returns continuously to the pump suction to be driven again towards the nozzles; the series of nozzles are adapted to the drying system by means of a vertical coupling at predetermined depth of a first set of nozzles, which are introduced by the upper part of the drum at points adjacent to the wall side of the drum, in such a way that does not impede the rotation of the drum and produce recirculating currents along vertical planes; further comprising a second set of nozzles located opposite the first set of nozzles; the operation of the nozzles is periodically alternated by means of a double pass control valve; the nozzles are telescopically mounted to adjust them to the water level in the feed tubing coming from the outside of the drum from the discharge of the system's pump; the water returns continuously to the pumps suction through the holes located in the rotatory inner drum and by the overflow and draining system of the external drum; the rotatory and floating internal drum has a plurality of holes or long and narrow grooves vertically located around the whole conical wall side of its bottom and below the peripheral zone covering the nozzles; the plurality of grooves are communicated with a closed chamber located below them; the chamber has a plurality of holes of predetermined area that allow the pass to the exterior of the drum of only a portion of the water from the jets of the nozzles; the cylindrical body of the drum has holes only in its upper half part or in its upper part and also comprises a series of holes of limited area for operation of the centrifugation, that are located in the detent bend zone; in the upper part of the tubing that feeds the nozzles, it is connected a bypass tubing of lower diameter, through which a small part of the flow of water is bypassed, said bypass tubing is connected to a Venturi type vacuum pump, that absorbs air at low pressure and discharges it together with the water current at the exit of the nozzles.

9. Wash system according to claim 8, wherein the bubbles injector comprises a Venturi type vacuum pump, which is connected in series to the bypass tube; the vacuum pump suction tube is connected to a closed container, in which vacuum is produced and the exit thereof is connected to the discharge of the water jets injecting nozzles; the closed container houses water which is heated at the evaporation temperature by means of a heating element to produce formation of bubbles.

10. Wash system according to claim 1, comprising also a bubble injector, consisting of a tubing bypass connected with the tube that feeds the injecting nozzles and having a lower diameter and whose function is to inject water steam bubbles at low pressure within the wash currents to produce cavitation shock waves; the diameter of the bubbles injector is reduced gradually in the way of a Venturi tube to sufficiently lower the water pressure circulating therethrough and abruptly widening, forming a short length vacuum chamber, after which reduces again gradually its diameter to reach the initial or entrance diameter and ending and discharging at the exit of the nozzles; at the exit point from the vacuum chamber, the bubble injector tube has a series of small longitudinal and vanished veins having as object to drag the air and water steam.

11. Wash system according to claim 1, comprising a bubbles injector which comprises a Venturi type vacuum pump, which is connected in series to a bypass tube; the vacuum pump suction tube is connected to a closed container, in which vacuum is produced and the exit thereof is connected to the discharge of the water jets injecting nozzles; the closed container houses water which is heated at the evaporation temperature by means of a heating element to produce formation of bubbles.

* * * * *